US008939116B2

(12) United States Patent
Pöschl et al.

(10) Patent No.: US 8,939,116 B2
(45) Date of Patent: Jan. 27, 2015

(54) LIQUID-COOLED INTERNAL COMBUSTION ENGINE

(75) Inventors: Robert Pöschl, Graz-Andritz (AT); Manfred Breitenberger, Graz (AT)

(73) Assignee: AVL List GmbH, Graz (AT)

( * ) Notice: Subject to any disclaimer, the term of this patent is extended or adjusted under 35 U.S.C. 154(b) by 0 days.

(21) Appl. No.: 13/983,612

(22) PCT Filed: Jan. 18, 2012

(86) PCT No.: PCT/EP2012/050678
§ 371 (c)(1), (2), (4) Date: Oct. 3, 2013

(87) PCT Pub. No.: WO2012/101014
PCT Pub. Date: Aug. 2, 2012

(65) Prior Publication Data

US 2014/0020639 A1 Jan. 23, 2014

(30) Foreign Application Priority Data

Jan. 27, 2011 (AT) ..... A 108/2011

(51) Int. Cl.
*F02F 1/36* (2006.01)
*F02F 1/40* (2006.01)
*F01P 3/02* (2006.01)

(52) U.S. Cl.
CPC .... *F01P 3/02* (2013.01); *F02F 1/40* (2013.01)
USPC ..... 123/41.82 R; 123/193.5

(58) Field of Classification Search
USPC ..... 123/41.82 R, 41.82 A, 193.5
See application file for complete search history.

(56) References Cited

U.S. PATENT DOCUMENTS 4,889,080 A 12/1989 Oguri

FOREIGN PATENT DOCUMENTS

| | | | |
|---|---|---|---|
| AT | 005939 | U1 | 1/2003 |
| AT | 503182 | A2 | 8/2007 |
| AT | 501008 | A2 | 3/2011 |
| DE | 10331918 | A1 | 2/2004 |
| JP | 2001200753 | A | 7/2001 |

*Primary Examiner* — Noah Kamen
(74) *Attorney, Agent, or Firm* — Jordan IP Law, LLC; Todd A. Vaughn

(57) ABSTRACT

A liquid-cooled internal combustion engine having at least one cylinder with a cylinder head in which there are disposed a lower partial cooling chamber adjacent to a fire deck and an upper partial cooling chamber which is flow-connected thereto by way of at least one main overflow aperture.

20 Claims, 2 Drawing Sheets

LIQUID-COOLED INTERNAL COMBUSTION ENGINE

CROSS-REFERENCE TO RELATED APPLICATIONS

The present application is a National Stage Application of PCT International Application No. PCT/EP2012/050678 (filed on Jan. 18, 2012), under 35 U.S.C. §371, which claims priority to Austrian Patent Application No. A 108/2011 (filed on Jan. 27, 2011), which are each hereby incorporated by reference in their respective entireties.

TECHNICAL FIELD

The invention relates a liquid-cooled internal combustion engine, comprising at least one cylinder, having a cylinder head in which there are disposed a lower partial cooling chamber adjacent to a fire deck and an upper partial cooling chamber which is flow-connected thereto by way of at least one main overflow aperture.

BACKGROUND

An internal combustion engine with a cylinder head and a crankcase is known from AT 501 008 A2, wherein the cylinder head comprises a lower and an upper partial cooling chamber, and wherein the two partial cooling chambers are separated from one another by an intermediate deck. The coolant flows from a cooling chamber out of the crankcase into the lower partial cooling chamber and reaches the upper partial cooling chamber via an annular flow transfer between the intermediate deck and a receiving sleeve for a central component, from which the coolant flows via a lateral outlet opening into a coolant collecting chamber.

A similar cylinder head is known from AT 005 939 U1. This cylinder head is designed for a reversed coolant flow, however. The coolant flows from the upper partial cooling chamber via an annular transfer opening between the intermediate deck and a receiving sleeve for a central component into the lower partial cooling chamber and is guided via transfer openings into the cooling chamber of the crankcase. In the case of cylinder heads where coolant flows through said cylinder heads from the lower partial cooling chamber to the upper partial cooling chamber, the cooling of thermally critical regions of the fire deck is insufficient due to flow separations.

A liquid-cooled internal combustion engine with a cylinder housing for at least one cylinder and at least one cylinder head is further known from AT 503 182 A2. In this case, the upper partial cooling chamber is flow-connected via rising channels to the cooling chamber of the crankcase. The coolant reaches the upper partial cooling chamber directly from the cooling chamber of the crankcase via the rising channels and flows via an annular transfer opening between the intermediate deck and a receiving sleeve for a central component into the lower partial cooling chamber. The coolant leaves the bottom partial cooling chamber via lateral outlet openings.

Known cylinder heads come with the disadvantage that the intermediate deck is only insignificantly supported in the region of the cylinder centre to the fire deck by the annular transfer opening between the upper and lower partial cooling chamber, thereby allowing relatively large deflections to occur and thereby impairing the durability of the cylinder head.

SUMMARY

It is the object of the invention to avoid these disadvantages and to ensure optimal cooling of areas of fire decks that are subject to high thermal stresses and to increase the stiffness of the cylinder head.

This is achieved in accordance with the invention in such a way that at least one inflow duct, preferably at least one inflow duct per cylinder, is arranged between the upper partial cooling chamber and the lower partial cooling chamber, which inflow duct is flow-connected to the lower partial cooling chamber, preferably in a central region of the cylinder.

This allows the inflow of coolant in a central region from above into the lower partial cooling chamber, thereby allowing direct flow against thermally critical regions of the fire deck. This improves heat dissipation in the region of the exhaust valve seats and the valve bridges, so that thermal stresses can be reduced.

It is preferably provided that the inflow duct is flow-connected in a central region, preferably in the region of the cylinder axis, to the lower partial cooling chamber via at least one inlet opening which is preferably annular or shaped in the form of a ring segment. This allows a constant supply of coolant, which can be adjusted to the local thermal requirements of the subsequent valve bridge passages by local variation of the radial expansion of the annular inlet opening. The preferably closed annular chamber encloses a component opening into the combustion chamber, e.g., a fuel injection valve.

The coolant is guided from a central region of the lower partial cooling chamber via spoke-like ducts in the region of the valve bridges to the outside and flows about the exhaust ports and intake ports in the circumferential direction in the region of the valve seats. The coolant will be guided by the main overflow aperture into the upper partial cooling chamber, wherein at least one second overflow aperture allows fine adjustment of the mass flows between the individual valve bridges. After flowing through the upper partial cooling chamber, the coolant leaves the cylinder head through an outlet opening in the region of a first longitudinal side of the cylinder head. The main overflow aperture is ideally arranged in the region of the exhaust valve bridges, preferably in the region of the second longitudinal side of the cylinder head facing away from the outlet opening.

Simple guidance of the duct can be achieved when the inflow duct is formed in the manner of a hook and produced by casting. It can be provided that the inflow duct is arranged at least in sections substantially normally to the cylinder axis and is preferably flow-connected to an inlet duct which is arranged substantially parallel to the cylinder axis and which originates from at least one transfer opening in the fire deck.

The inflow duct is separated from the upper partial cooling chamber by a separating wall.

In order to keep deflections of the bottom separating wall as low as possible, it is advantageous if the annular space is adjacent to a receiving trimming for the central component, wherein the receiving trimming is connected to the fire deck and the bottom separating wall. The receiving trimming therefore acts as a central support element for the bottom separating wall. As a result, the stiffness of the cylinder head in the central region and both the thermal and also the structural sturdiness can be increased.

In order to promote the filling of the cooling system with coolant, it is provided that at least one degassing transfer is arranged between the inflow duct and the upper partial cooling chamber, wherein preferably the degassing transfer is arranged in the region of the first longitudinal side of the cylinder head or in the region of the receiving trimming.

DRAWINGS

The invention will be explained below in closer detail by reference to the drawings, wherein.

DRAWINGS

Figure 1:
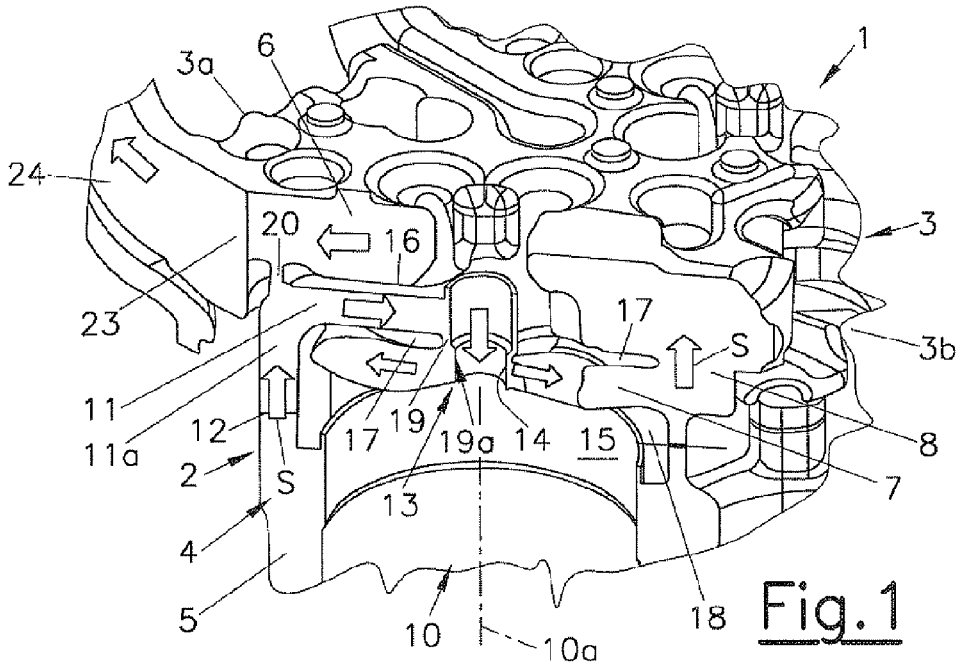
FIG. 1 illustrates an internal combustion engine in accordance with the invention in a sectional oblique view.

Functionally identical parts are provided in the embodiments with the same reference numerals.

The internal combustion engine 1 comprises a cylinder housing 2 and a cylinder head 3. A cooling system 4 is provided with a cooling fluid for cooling, which flows through a cooling jacket 5 in the cylinder housing 2 and through upper and lower partial cooling chambers 6, 7 in the cylinder head 3. The upper partial cooling chamber 6 and the lower partial cooling chamber 7 are flow-connected to each other via a main overflow aperture 8 per cylinder 10. A hook-like inflow duct 11 is arranged in the cylinder head 3, which duct originates from a transfer opening 12 in the region of the first longitudinal side 3*a* in the fire deck 18 and is guided radially into a central region 13 of the cylinder 10 between the lower partial cooling chamber 7 and the upper partial cooling chamber 6. A receiving trimming 14 for a receiving sleeve 25 for accommodating a component opening into the combustion chamber 15 is arranged in the central region 13, wherein the receiving trimming 14 extends between the bottom separating wall 17 separating the upper partial cooling chamber 6 from the lower partial cooling chamber 7 and the fire deck 18 adjacent to the cylinder housing 2. The inflow duct 11 is separated by an upper separating wall 16 from the upper partial cooling chamber 6, which can be formed by the bottom separating wall 17. An annular entrance opening 19 is provided between the inflow duct 11 and the lower partial cooling chamber 7, the annular space of which is designated with reference numeral 19*a*. Reference numeral 20 designates a degassing transfer between the inflow duct 11 and the upper partial cooling chamber 6.

Figure 2:
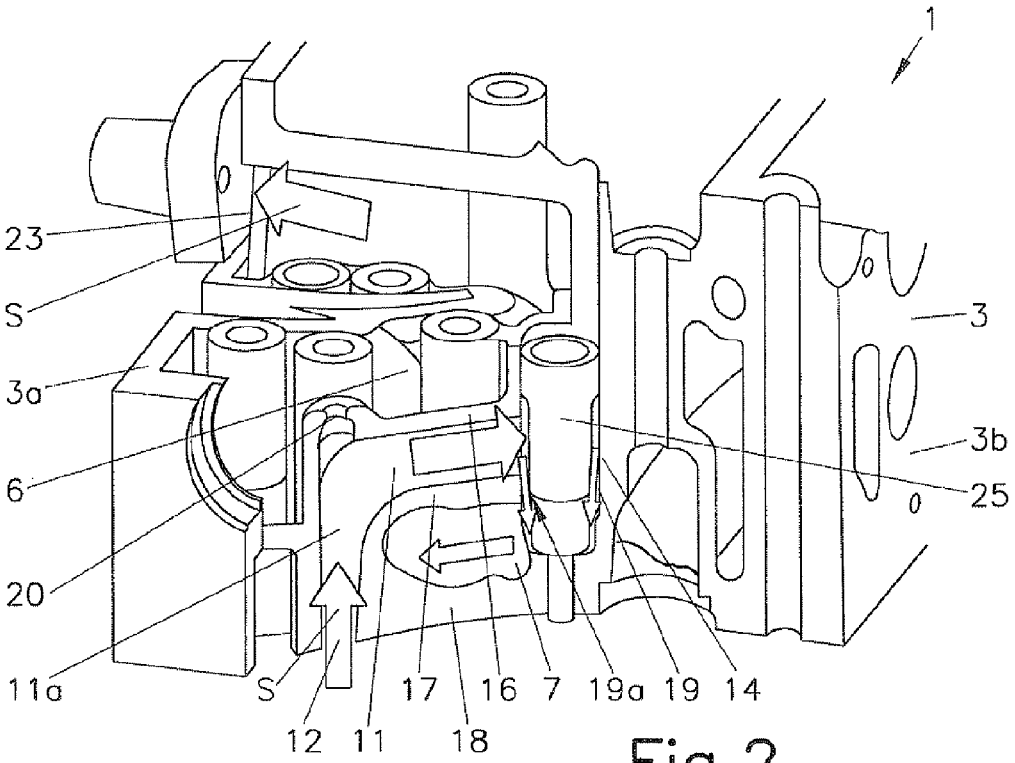
FIG. 2 illustrates a cylinder head of this internal combustion engine in a sectional oblique view.
Figure 3:
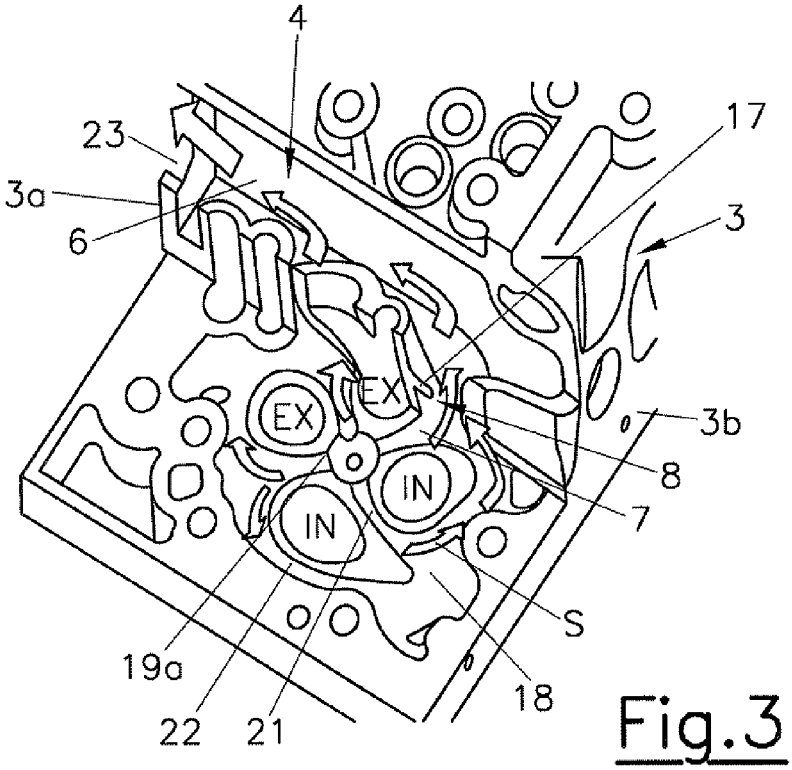
FIG. 3 illustrates a cylinder head of the internal combustion engine in a further sectional oblique view.

The coolant flows according to the arrows S from the cooling chamber 5 of the cylinder housing 2 via the inflow duct 11 and the annular entrance opening 19 into the lower partial cooling chamber 7 and is guided to the outside via radial ducts 21 between the intake and exhaust ports in the region of the valve bridges. After flowing around the intake and exhaust ports, which are designated in FIG. 2 with IN and EX, the coolant reaches the annular space 22, which is preferably enclosed on the outside around the intake and exhaust ports, and further via preferably a main overflow aperture 8 in the region of the second longitudinal side 3*b* of the cylinder head 1 into the upper partial cooling chamber 6. After passing through the upper partial cooling chamber 6, the coolant flows through a coolant outlet 23 on the first longitudinal side 3*a* of the cylinder head out of the cylinder head 3 and enters a coolant receptacle 24.

Since the receiving trimming 14 is rigidly connected to the bottom separating wall 17 and the fire deck 18, deflections of the bottom separating wall 17 and the fire deck 18 are decreased and the strength of the cylinder head is increased. The central inflow of the coolant through the inflow duct 11 from the side of the upper partial cooling chamber 6 into the lower partial cooling chamber 7, by directly flowing against thermally critical regions of the fire deck 18, leads to optimal cooling, especially the regions subject to high thermal stresses around the exhaust valve bridges.

What is claimed is:

1. A liquid-cooled internal combustion engine, comprising:

at least one cylinder having a cylinder head in which there are disposed a lower partial cooling chamber adjacent to a fire deck and an upper partial cooling chamber which is flow-connected thereto by way of at least one main overflow aperture;

at least one an inflow duct per cylinder arranged between the upper partial cooling chamber and the lower partial cooling chamber, the at least one inflow duct being flow-connected to the lower partial cooling chamber in a central region of the cylinder.

2. The liquid-cooled internal combustion engine of claim 1, wherein the inflow duct is flow-connected in a region of a cylinder axis to the lower partial cooling chamber via at least one inlet opening.

3. The liquid-cooled internal combustion engine of claim 1, wherein the inflow duct is flow-connected to an inlet duct which is arranged substantially parallel to the cylinder axis and which originates from at least one transfer opening in the fire deck.

4. The liquid-cooled internal combustion engine of claim 1, wherein the inflow duct is arranged in a manner of a hook.

5. The liquid-cooled internal combustion engine of claim 1, wherein the inflow duct is arranged at least in sections substantially normally to the cylinder axis.

6. The liquid-cooled internal combustion engine of claim 1, further comprising an upper separating wall arranged between the inflow duct and the upper partial cooling chamber.

7. The liquid-cooled internal combustion engine of claim 1, further comprising a receiving trimming for a central component connected to the fire deck and a bottom separating wall.

8. The liquid-cooled internal combustion engine of claim 1, wherein the upper partial cooling chamber is connected to at least one coolant outlet.

9. The liquid-cooled internal combustion engine of claim 8, further comprising a coolant outlet per cylinder arranged in a region of a first longitudinal side of the cylinder head.

10. The liquid-cooled internal combustion engine of claim 9, wherein the at least one main overflow aperture is arranged between the lower partial cooling chamber and the upper partial cooling chamber in a region of a second longitudinal side facing away from the coolant outlet.

11. The liquid-cooled internal combustion engine of claim 1, wherein the at least one main overflow aperture is arranged between the lower partial cooling chamber and the upper partial cooling chamber in a region of at least one radial duct between two exhaust ports.

12. The liquid-cooled internal combustion engine of claim 1, further comprising at least one degassing transfer arranged between the inflow duct and the upper partial cooling chamber.

13. The liquid-cooled internal combustion engine of claim 12, wherein the at least one degassing transfer is arranged in a region of a first longitudinal side of the cylinder head.

14. The liquid-cooled internal combustion engine of claim 1, wherein an entrance opening is formed by an annular space which encloses a receiving trimming for the central component at least in part.

15. The liquid-cooled internal combustion engine of claim 14, further comprising at least one degassing transfer arranged between the inflow duct and the upper partial cooling chamber.

16. The liquid-cooled internal combustion engine of claim 15, wherein the at least one degassing transfer is arranged in a region of the receiving trimming.

17. An internal combustion engine, comprising:

a cylinder having a cylinder head;

a cooling chamber configured to cool the internal combustion engine, the cooling chamber having a lower partial cooling chamber disposed in the cylinder adjacent to a fire deck and an upper partial cooling chamber disposed in the cylinder and which is flow-connected to the lower partial cooling chamber by way of a main overflow aperture; and an inflow duct per cylinder arranged between the upper partial cooling chamber and the lower partial cooling chamber, the inflow duct being flow-connected to the lower partial cooling chamber in a central region of the cylinder.

18. The internal combustion engine of claim 17, wherein the inflow duct is flow-connected in a region of a cylinder axis to the lower partial cooling chamber via at least one inlet opening.

19. The internal combustion engine of claim 17, wherein the inflow duct is flow-connected to an inlet duct which is arranged substantially parallel to the cylinder axis and which originates from at least one transfer opening in the fire deck.

20. The internal combustion engine of claim 17, wherein the inflow duct is arranged at least in sections substantially normally to the cylinder axis.

* * * * *